US010494986B2

(12) United States Patent
Noppakunkajorn et al.

(10) Patent No.: US 10,494,986 B2
(45) Date of Patent: Dec. 3, 2019

(54) LOW TEMPERATURE COOLANT RESERVOIR CAP DESIGN WITH AIR GAP FOR HYBRID VEHICLES

(71) Applicant: Ford Global Technologies, LLC, Dearborn, MI (US)

(72) Inventors: Jukkrit Noppakunkajorn, Canton, MI (US); Sudhir Kumar, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/729,717

(22) Filed: Oct. 11, 2017

(65) Prior Publication Data

US 2019/0107038 A1 Apr. 11, 2019

(51) Int. Cl.
*F01P 11/02* (2006.01)
*B65D 41/04* (2006.01)

(52) U.S. Cl.
CPC ..... *F01P 11/0214* (2013.01); *B65D 41/0471* (2013.01)

(58) Field of Classification Search
CPC .. F01P 11/0214; B65D 41/0471; B65D 41/04; B65D 41/06; B65D 41/17; B65D 41/46; B65D 53/00; B65D 1/023; B65D 1/0246; B65D 1/0223
USPC .... 220/288, 293, 305, 304, 378, 368, 367.1, 220/582, 562; 215/318, 317, 316, 329, 215/45, 44, 43
See application file for complete search history.

(56) References Cited

U.S. PATENT DOCUMENTS 1,520,212 A 12/1924 Songer
1,616,050 A * 2/1927 Kania ..... A47J 27/10 126/377.1
1,670,668 A * 5/1928 Oishei ..... F01P 11/0214 220/288
1,741,364 A * 12/1929 Hennebohle ..... F23D 5/00 431/214
2,663,451 A 10/1951 Yarnell
2,705,088 A * 3/1955 Van Blarcom ..... B65D 41/0435 220/259.3
2,760,367 A * 8/1956 Stromberg ..... G01M 3/025 73/40
2,840,034 A 6/1958 Danias
3,415,405 A 10/1968 Rausing et al.
(Continued)

FOREIGN PATENT DOCUMENTS

GB 142751 A * 5/1920 ..... B65D 41/04

*Primary Examiner* — Robert J Hicks

(57) ABSTRACT

A cap for a coolant reservoir that accommodates the expansion of coolant stored therein. The expanding coolant results from an increase in temperature and causes an increase in pressure to build within the coolant reservoir. The cap includes a base and a crown having an air-dome which extends upwardly therefrom. The base includes a passageway extending therethrough and in fluid communication with an interior cavity or an "air gap" formed in the crown. As the cap is positioned over an open neck of the coolant reservoir, by being screwed or otherwise fitted thereon, the interior cavity remains positioned above the neck. Thus, as the coolant within the coolant reservoir becomes heated and expands, the interior cavity provides additional space for the coolant to occupy and pressure to build within.

17 Claims, 5 Drawing Sheets

(56) References Cited

U.S. PATENT DOCUMENTS

| | | | | | |
|---|---|---|---|---|---|
| 3,495,993 | A * | 2/1970 | Johnson | A61J 11/0095 | 426/117 |
| 3,888,382 | A * | 6/1975 | Blumhardt | A01M 7/0085 | 215/307 |
| 4,223,799 | A * | 9/1980 | Eyster | B60K 15/0406 | 215/201 |
| 4,284,213 | A * | 8/1981 | Lee | B65D 47/10 | 220/266 |
| 4,671,421 | A * | 6/1987 | Reiber | B65D 1/46 | 215/228 |
| 6,648,188 | B2 * | 11/2003 | Brecheisen | B29C 49/04 | 215/44 |
| 2005/0205513 | A1 * | 9/2005 | Hidding | B65D 1/023 | 215/246 |
| 2007/0246463 | A1 | 10/2007 | Hoffman | | |
| 2017/0291751 | A1 * | 10/2017 | Roh | B65D 81/32 | |

* cited by examiner

LOW TEMPERATURE COOLANT RESERVOIR CAP DESIGN WITH AIR GAP FOR HYBRID VEHICLES

TECHNICAL FIELD

The disclosed inventive concept relates to components, such as vehicle components. More particularly, the disclosed inventive concept concerns caps for coolant reservoirs. Even more particularly, the disclosed inventive concept relates to caps for coolant reservoirs that accommodate for an increase in coolant volume due to an increase in coolant temperature.

BACKGROUND OF THE INVENTION

On average, a typical 4-cylinder vehicle operating at 50 miles per hour will produce approximately 4,000 explosions per minute within its internal combustion engine as the spark plug ignites fuel in each cylinder. If not for the cooling system, the engine would be heavily damaged due to the large amount of heat created.

The cooling system or cooling loop in a vehicle includes, generally, a coolant reservoir for storing coolant (or antifreeze) not currently in circulation, passages within the engine block and heads, a water pump for circulating the coolant through the passages, a thermostat for regulating the flow of the coolant, and a radiator for drawing heat out of the coolant.

The coolant reservoir functions to store excess or overflowing coolant. The coolant reservoir includes a coolant reservoir cap which, when removed, allows for additional coolant to be added into the cooling reservoir and, in turn, pumped through the cooling loop. Standard coolant reservoir caps can withstand a pressure buildup within the reservoir of approximately 21 psi.

As coolant flows out of the coolant reservoir and through the various passages of the cooling loop, it draws heat away from the surrounding components, thereby cooling the engine. Thereafter, the coolant flows through the radiator and is cooled by fresh air entering the engine compartment through the grill in the front of the vehicle. This process repeats as the coolant is recirculated through the engine in order to continually draw heat away from the engine.

Hybrid vehicles include an inverter for converting the direct current output from the battery to alternating current used by an electric motor. This conversion produces additional waste heat that needs to be dissipated. Therefore, hybrid vehicles will oftentimes include a secondary or "inverter" coolant reservoir for specifically cooling the hybrid components in a lower temperature cooling loop, such as an electric motor, a DC-DC power converter, a charger, and the like. The inverter coolant reservoir is separate from the internal combustion engine coolant reservoir.

Coolant, conventionally used in today's internal combustion engine also referred to as antifreeze, is created by mixing water with a suitable organic chemical, such as ethylene glycol, diethylene glycol, or propylene glycol. This mixture allows for the coolant to remain a liquid at very low temperatures (below 0° C.) and avoid evaporating at very high temperatures (above 100° C.). However, as coolant gets hot, it begins to expand and causes an increase in pressure within the cooling system. Therefore, the radiator includes a radiator pressure cap that maintains the pressure in the cooling system by releasing a small amount of coolant through the cap as necessary to equalize the pressure therein.

When additional coolant is required for circulation, coolant flows of a respective coolant reservoir.

In order to prevent a buildup of pressure within the coolant reservoir, itself, coolant reservoirs typically include a marking or "max fill line" formed thereon to indicate when the coolant reservoir is filled with an appropriate level of coolant. However, it is not uncommon for people to unintentionally fill the coolant reservoir above the max fill line. As a result, when the coolant stored within the coolant reservoir becomes heated, the expanding coolant causes pressure to build within the reservoir and the cooling loop. This creates an increased risk of the coolant reservoir rupturing or coolant leaking out of the reservoir and damaging the surrounding components.

The prior art addressed this situation by proposing a number of devices to counteract the increased pressure within a cooling system, such as those disclosed in U.S. Pat. Nos. 1,520,212, 2,663,451, 2,840,034, and 3,415,405, and U.S. Patent Application Publication No. 2007/0243463.

In view of the state of the art, it may be advantageous to provide an improved cap for a low temperature cooling loop reservoir in a hybrid vehicle. As in so many areas of vehicle technology, there is always room for improvement related to various vehicular cooling system components.

SUMMARY OF THE INVENTION

The disclosed inventive concept overcomes the problems associated with known cooling systems for use with hybrid vehicles by providing an improved cap for a coolant reservoir, namely, an inverter cooling reservoir in a hybrid vehicle. The disclosed inventive concept offers the significant general advantage of allowing for coolant to expand while being subjected to high operating pressures for a long duration of time.

Particularly, the disclosed inventive concept provides a cap for a coolant reservoir having an open neck for pouring coolant thereinto. The cap generally includes a base and a crown disposed above the base. The base has a top surface, a bottom surface, an outer wall, and an inner wall which defines a passageway extending through the top and bottom surfaces. The crown has a sidewall and a top wall which provide an air-dome. The sidewall and the top wall cooperate with one another to define an interior cavity formed therein.

When the cap is positioned onto the neck of the coolant reservoir either by being screwed, press-fitted, or otherwise emplaced thereon, the interior cavity of the crown is located above the neck. Thus, as the coolant within the coolant reservoir becomes heated and expands, the interior cavity provides additional space or an "air gap" for the coolant to occupy without resulting in a dangerous amount of pressure building within the cap. This air-dome in the crown, along with the additional space provided therein, contain the high pressure contingency and prevents the coolant from leaking out of the cap and onto the surrounding components. Moreover, the air-dome allows for coolant to expand and for air to compress therein in order to prevent coolant from leaking out of any hybrid module cold plates in the cooling loop.

Preferably, the cap further includes an indentation formed in the inner wall of the base in order to seat the cap over the top of the neck of the coolant reservoir. The indentation prevents the cap from being lowered too far onto the neck of the coolant reservoir and ensures that the interior cavity remains above the neck at all times.

The above advantages, in addition to other advantages and features, will be readily apparent from the following detailed description of the invention when taken in connection with the accompanying drawings.

BRIEF DESCRIPTION OF THE DRAWINGS

For a more complete understanding of this disclosed inventive concept, reference should now be made to the embodiments illustrated in greater detail in the accompanying drawings and described below by way of examples of the disclosed inventive concept wherein.

DETAILED DESCRIPTION OF THE INVENTION

Figure 1:
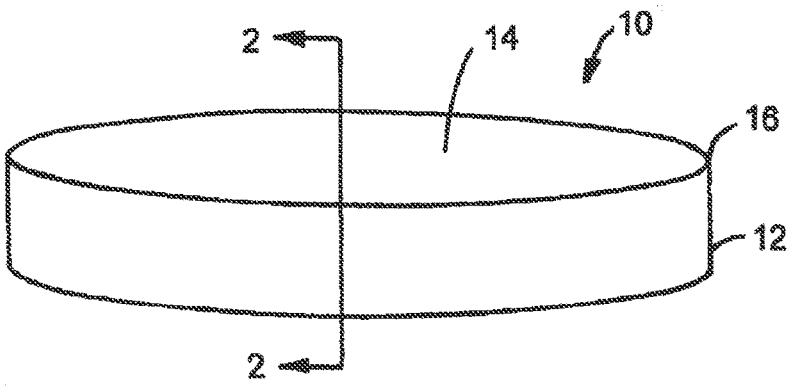
FIG.1 PRIOR ART
FIG. 1 is a perspective view of a cap in accordance with the prior art.

In the following figures, the same reference numerals will be used to refer to the same components. In the following description, various operating parameters and components are described for different constructed embodiments. These specific parameters and components are included as examples and are not meant to be limiting.

Figure 2:
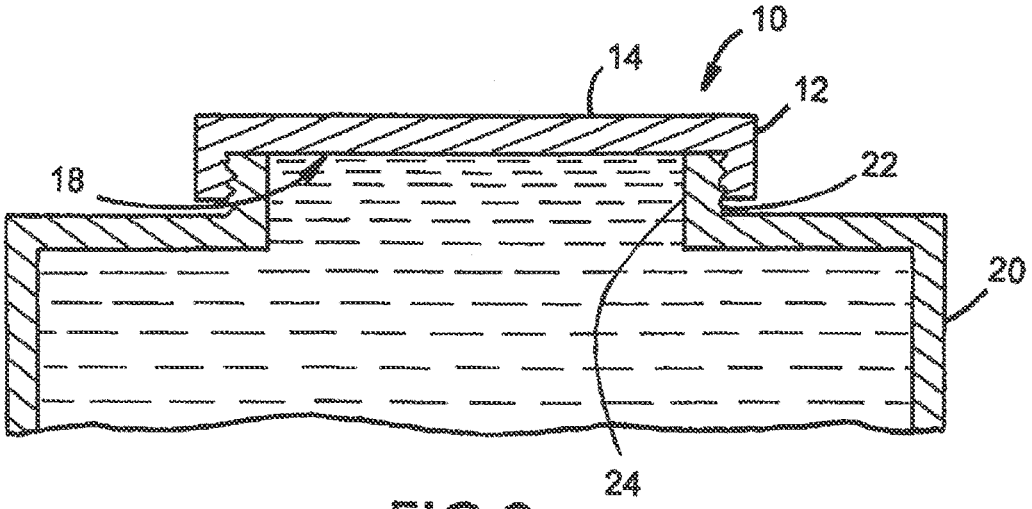
FIG.2 PRIOR ART
FIG. 2 is cross-sectional view of the cap of FIG. 1 taken along line 2-2 and positioned onto the neck of a coolant reservoir.

As shown in FIGS. 1 and 2, a cap in accordance with the prior art is shown as 10. The cap 10, generally, comprises a sidewall 12 and a top wall 14. The sidewall 12 extends downwardly from a perimetral edge 16 of the top wall 14. The sidewall 12 and the top wall 14 cooperate to define a hollow interior 18 within the cap 10.

As shown in FIG. 2, the cap 10 is shown in position on a coolant reservoir 20 having a neck 22. The neck 22 includes an opening 24 formed therein which allows one to fill the coolant reservoir 20 with coolant when necessary. The interior 18 of the cap 10 receives the neck 22 of the coolant reservoir 20 such that the top wall 14 of the cap 10 lies flush against the opening 24 of the neck 22 when seated thereon.

As is known, utilizing the cap 10 fails to provide any additional space for coolant to occupy when pressure builds within the coolant reservoir 20 due to the coolant becoming hot and expanding. As a result, when coolant is accidentally filled to the top of the neck 22, the cap 10 and the coolant reservoir 20 exhibit an increased risk of rupturing and coolant is more likely to leak out of the coolant reservoir 20 and onto the surrounding components.

Figure 3:
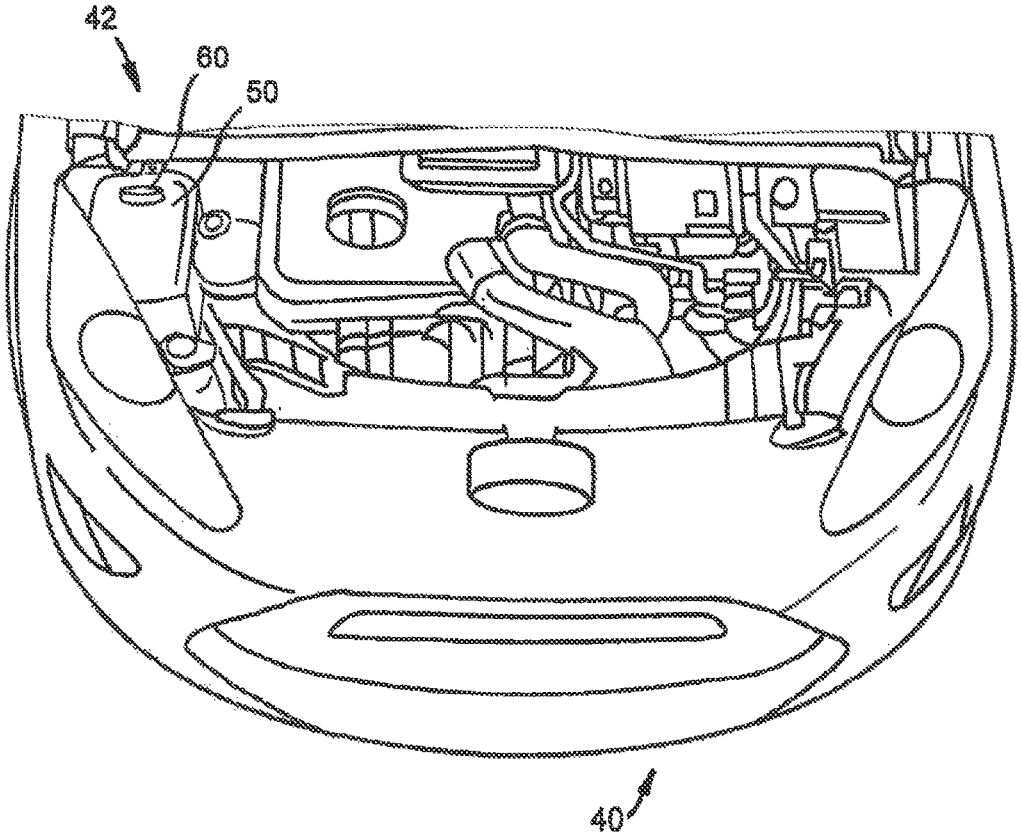
FIG. 3 is an environmental view showing a cap in accordance with the disclosed inventive concept on a hybrid vehicle.
Figure 4:
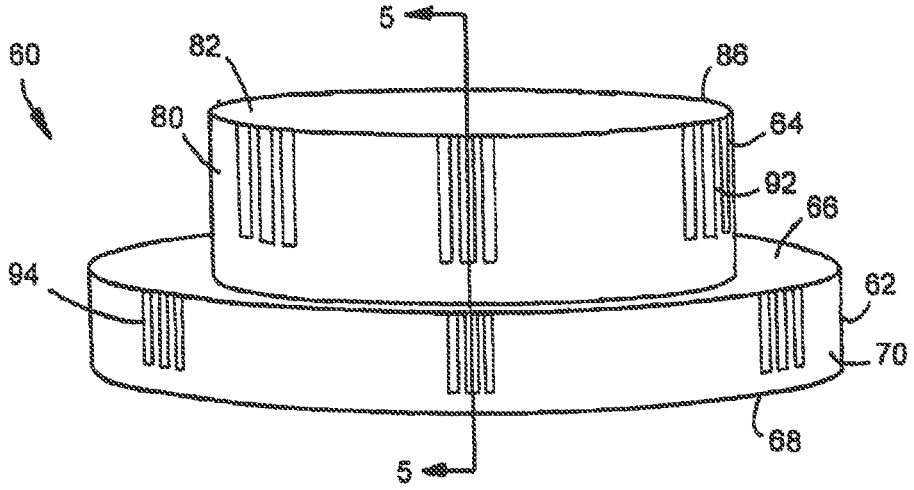
FIG. 4 is a perspective view of the cap hereof.
Figure 5:
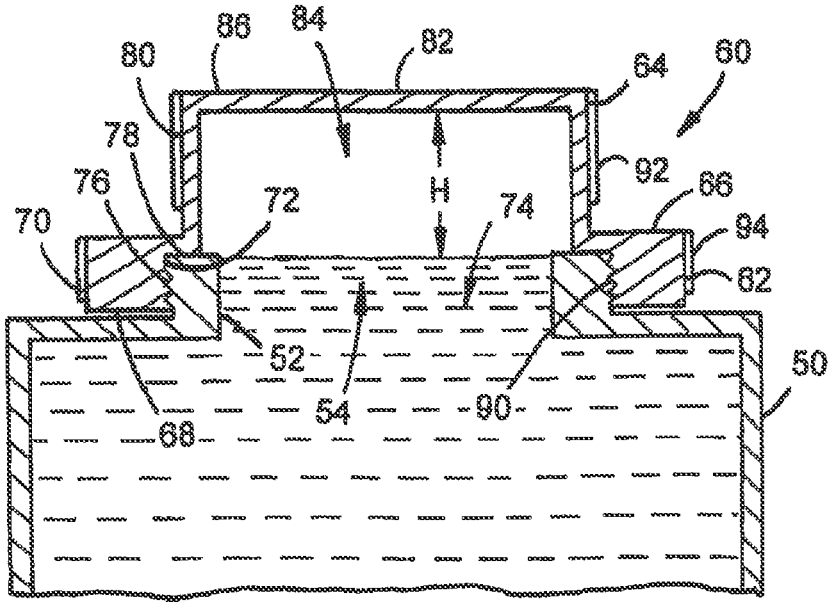
FIG. 5 is a cross-sectional view of the cap of FIG. 4 taken along line 5-5 and positioned onto the neck of a coolant reservoir.

Therefore, in accordance with the disclosed inventive concept and with reference now to FIGS. 3-5, there is provided an improved cap, denoted at 60, for a coolant reservoir which addresses this problem.

As shown in FIG. 3, an environmental view illustrates the cap in position on a hybrid vehicle 40. More specifically, the cap 60 is shown positioned on an inverter coolant reservoir 50 within a low temperature cooling loop 42. It is understood that the location of the coolant reservoir 50 is not limited to that shown in FIG. 3 and may be moved to any suitable location without departing from the scope of the disclosed inventive concept. Furthermore, it is to be understood that the cap 60 hereof is equally applicable with an internal combustion engine coolant reservoir for a non-hybrid vehicle as well.

With more particularity, as shown in FIGS. 4 and 5, the cap 60, generally, comprises a base 62 and a crown 64. The base 62 has a top surface 66, a bottom surface 68, and an outer wall 70. The base 62 also has an inner wall 72 which defines a passageway 74 extending axially or vertically through the top and bottom surfaces 66, 68 of the base 62. Preferably, the passageway 74 is formed through a substantially central portion of the base 62.

The base 102 further includes an indentation 76 formed within the inner wall 72 and extends into the base 62. The indentation 76 cooperates with the inner wall 72 to provide a ledge 78.

With regard to the crown 64, the crown 64 extends upwardly from the base 62 and includes a sidewall 80 and a top wall 82 to provide an air-dome 84 for containing the high pressure contingency, as discussed below. The sidewall 80 extends between the top surface 66 of the base 62 and a perimetral edge 86 of the top wall 82. The sidewall 80 and the top wall 82 cooperate to define an interior cavity 88 within the crown 64. Preferably, the base 62 and the crown 64 are joined to form an integral, unitary structure.

As shown in FIG. 5, the cap 60 is positioned on the neck 52 of the coolant reservoir 50. The neck 52 has an opening 54 formed therein and terminates within the coolant reservoir 50. The ledge 78 formed in the base 62 facilitates seating the cap 60 onto the neck 52 of the coolant reservoir 50.

As illustrated, the base 62 is circular, but may comprise any other suitable geometry. However, it is critical that the diameter of the passageway 74 between the indentation 76 is substantially equal to the outer diameter of the neck 52 of the coolant reservoir 50 in order to provide a sufficient seal therebetween.

The interior cavity 88 in the crown 64 is defined by a height H between the top of the indentation 76 in the base 62 and the top wall 82 of the crown 64. When the cap 60 is positioned on the neck 52 of the coolant reservoir 50, the interior cavity 88 is maintained at height H above the opening 54 in the neck 52 to provide an "air gap."

The passageway 74 is in fluid communication with the interior cavity 88 of the crown 64. Therefore, as opposed to the cap 10 in accordance with the prior art discussed above, which lies flat with the opening 24 formed in the neck 22 of the coolant reservoir 20, the cap 60 hereof allows for excess coolant filled to the top of the neck 22 to flow into the interior cavity 88 of the air-dome 84 and for pressure to build therein as necessary. In turn, the air-dome 84 contains the high pressure contingency that builds within the crown as the coolant expands. As a result, the air within the air-dome 84 and the interior cavity 88 compresses slightly, thereby preventing any leaks out of the cap 60 or, alternatively, out of any hybrid module cold plates within the cooling loop.

It is to be understood that the cap 60 may be either press-fitted or frictionally-fitted onto the neck 52 of the coolant reservoir 50. Here, the cap 60, or at least the base 62, is manufactured from any suitable material such as rubber, flexible plastic, or the like.

Alternatively, the inner wall 72 of the base 62 may include threads 90 such that the cap 60 may be screwed onto the neck 52 having corresponding threads. In this instance, it is to be understood that the base 62 need not include the indentation 76 formed therein as the cap 60 may be screwed onto the neck 52 as tight or as low as necessary.

When the cap 60 includes threads 90 and is to be screwed onto the neck 52, the crown 64, preferably, comprises a plurality of spaced apart projections 92 extending outwardly from the sidewall 80 thereof. The base 62 may also comprise a plurality of spaced apart projections 94 extending outwardly from the outer wall 70 thereof. The projections 92, 94 allow for one to better grip the cap 60 and facilitate screwing the cap 60 onto the neck 52.

Figure 6:
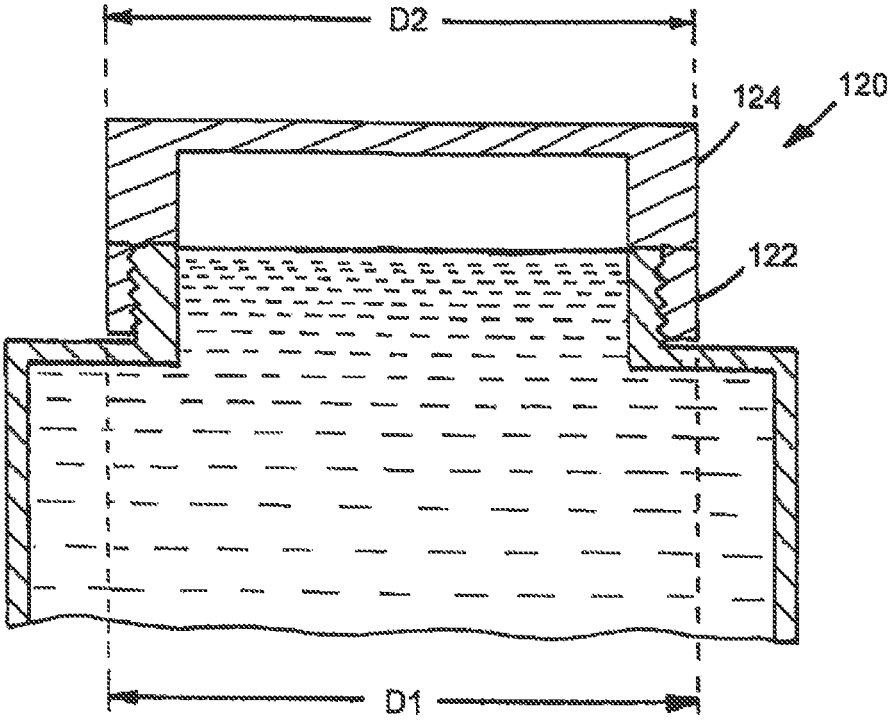
FIG. 6 is a cross-sectional view of a cap in accordance with the disclosed inventive concept being dimensionally different than the cap shown in FIG. 5 and positioned onto the neck of a coolant reservoir.

It is to be understood that while the base 62 is shown to have a larger outer diameter than the crown 64, the outer diameters may be substantially equal without deviating from the scope of the disclosed inventive concept. For example, as shown in FIG. 6, a cap 120 is illustrated having a base 122 with an outer diameter D1 equal to an outer diameter D2 of a crown 124.

Figure 7:
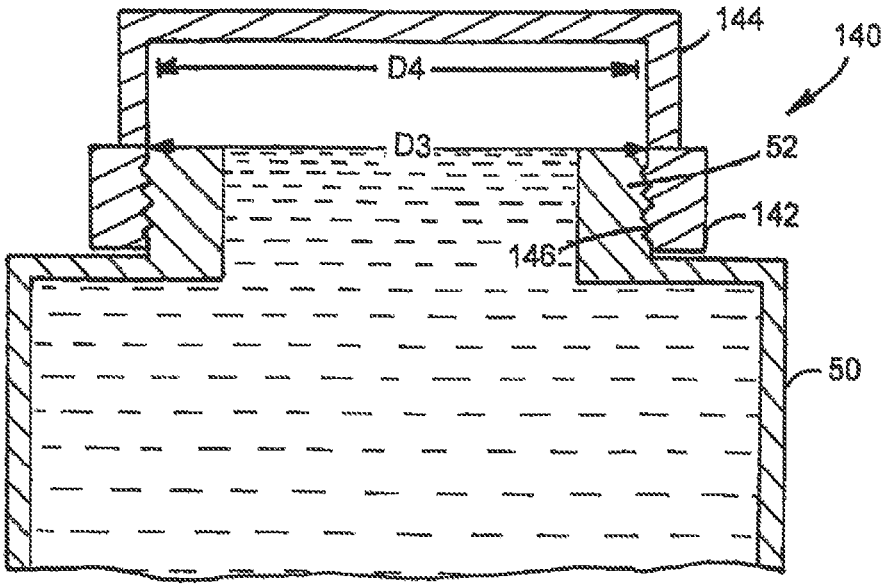
FIG. 7 is a cross-sectional view of a cap in accordance with the disclosed inventive concept being dimensionally different than the caps shown in FIGS. 5 and 6 and positioned onto the neck of a coolant reservoir.

Similarly, the inner diameters of the base 62 and the crown 64 of the cap 60 shown in FIGS. 4 and 5 may be equal, thereby eliminating the indentation 76 formed in the base 62. For example, as shown in FIG. 7, a cap 140 is illustrated comprising a base 142 with an inner diameter D3 equal to an inner diameter D4 of a crown 144. As a result, the cap 140 must be threadedly secured to the neck 52 via threads 146 due to the elimination of the ledge 78.

Figure 8:
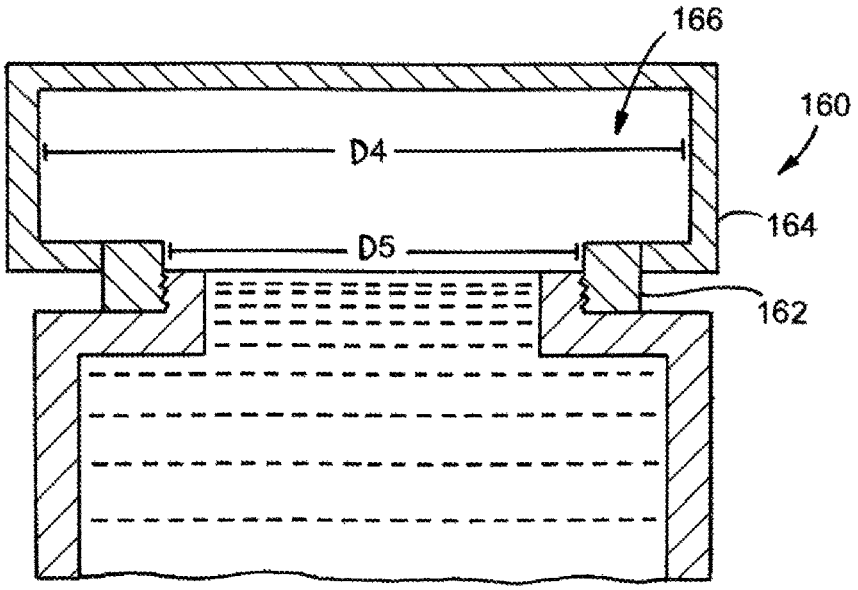
FIG. 8 is a cross-sectional view of a cap in accordance with the disclosed inventive concept being dimensionally different than the caps shown in FIGS. 5, 6, and 7 and positioned onto the neck of a coolant reservoir.

Alternatively, as shown in FIG. 8, a cap 160 is illustrated comprising a base 162 with an inner diameter D5, which is smaller than an inner diameter D6 of a crown 164. This provides the cap 160 with an air-dome 166 formed within the crown 166 that is wider than the base 162. Thus, it is to be understood that the dimensions of the crown 166 and the volume of the air-dome 166 formed therein are not restricted by the dimensions of the base 162. This allows for a larger area for coolant to build up within in order to prevent the cap 160 from rupturing.

Figure 9:
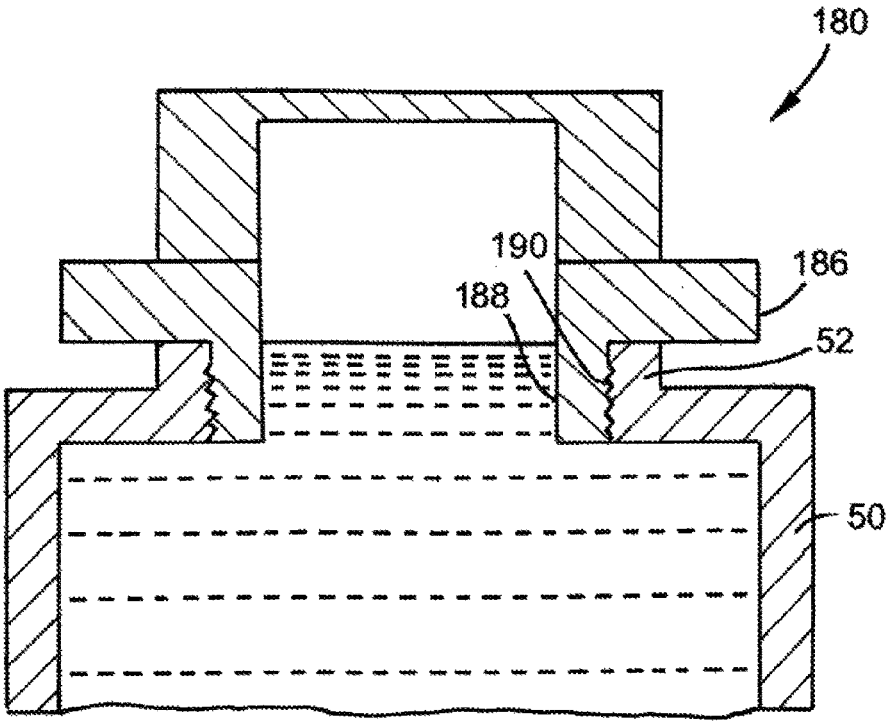
FIG. 9 is a cross-sectional view of a cap in accordance with the disclosed inventive concept being partially insertable into the neck of a coolant reservoir and threadably screwed thereto.

As noted above in FIGS. 5 and 7, the caps 60, 140 are threadably secured to the coolant reservoir 50 about the outer surface of the neck 52. However, it is to be understood that a cap in accordance with the disclosed inventive concept may similarly be threadably secured to the interior surface of the neck 52 by being partially insertable therein. Thus, as shown in FIG. 9, the disclosed inventive concept provides a cap 180 comprising a base 182 and a crown 184. The base 182 includes a planar member 186 and a projecting member 188. The projecting member 188 extends substantially perpendicular to the planar member 186 and has an outer diameter equal to that of the inner diameter of the neck 52. Preferably, the planar member 186 and the projecting member 188 are integrally formed therewith. The projecting member 188 also includes a plurality of threads 190, which mate with corresponding threads formed in the neck 52. As a result, the cap 180 is seated atop the neck 52 and secured to the coolant reservoir 50 via the mating connection of the projecting member 188 to the inner surface of the neck 52.

From the above, it is to be appreciated that defined herein is a new and unique cap for a coolant reservoir which accommodates for the expansion of coolant and a buildup of pressure therein. One skilled in the art will readily recognize from such discussion, and from the accompanying drawings and claims, that various changes, modifications, and other variations can be made therein without departing from the spirit and fair scope of the disclosed inventive concept as defined by the following claims.

LIST OF REFERENCE NUMERALS

10 Cap
12 Sidewall
14 Top wall
16 Perimetral edge of top wall
18 Interior of cap
20 Coolant reservoir
22 Neck of coolant reservoir
24 Opening in neck
40 Vehicle
42 Cooling loop
50 Coolant reservoir
52 Neck of coolant reservoir
54 Opening in neck
60 Cap
62 Base
64 Crown
66 Top surface of base
68 Bottom surface of base
70 Outer wall of base
72 Inner wall of base
74 Passageway in base
76 Indentation
78 Ledge of base
80 Sidewall of crown
82 Top wall of crown
84 Air-dome
86 Perimetral edge of top wall
88 Interior cavity of crown
90 Threads on base
92 Projections on crown
94 Projections on base
120 Cap
122 Base of cap 120
124 Crown of cap 120
140 Cap
142 Base of cap 140
144 Crown of cap
146 Threads on base 142
160 Cap
162 Base of cap 160
164 Crown of cap 160
166 Air-dome
180 Cap
182 Base
184 Crown
186 Planar member of base
188 Projecting member of base
190 Threads of projecting member
D1 Diameter of base 122
D2 Diameter of crown 124
D3 Diameter of base 142
D4 Diameter of crown 144
D5 Diameter of base 162
D6 Diameter of crown 164
H Height

What is claimed is:

1. A coolant reservoir system for a vehicle comprising:
a coolant reservoir having an open neck; and
a cap comprising:
a base having a top surface, a bottom surface, an outer wall, and an inner wall defining a passageway; and
a crown extending upwardly from said base, said crown including a sidewall and a top wall which cooperate to define an interior cavity having a constant inner diameter,
wherein said crown and said base are joined to form an integral, unitary structure,
wherein said interior cavity remains above the neck of the coolant reservoir when the cap is positioned thereon and accommodates the expansion of coolant and buildup of pressure within said coolant reservoir.

2. The coolant reservoir system of claim 1, wherein said cap is securable onto the neck of the coolant reservoir by being press-fitted thereon.

3. The coolant reservoir system of claim 1 further comprising threads disposed on the inner wall of said base for threadedly securing the cap onto the neck of the coolant reservoir.

4. The coolant reservoir system of claim 3, wherein said crown includes a plurality of spaced apart projections for gripping the cap.

5. The coolant reservoir system of claim 3, wherein said base includes a plurality of spaced apart projections for gripping the cap.

6. The coolant reservoir system of claim 1, wherein said base includes an indentation formed in the inner wall thereof which defines a ledge for seating the cap onto the neck of the coolant reservoir.

7. The coolant reservoir system of claim 1, wherein the interior cavity of said crown is in fluid communication with the passageway formed in said base.

8. The coolant reservoir system of claim 1, wherein said crown has an inner diameter that is greater than an inner diameter of said base.

9. A coolant reservoir system for a vehicle comprising:
a coolant reservoir having an open neck; and
a cap comprising:
a base having a passageway extending vertically therethrough, the base having an indentation formed within the passageway for seating the cap onto the neck of the coolant reservoir; and
a crown extending upwardly from the base, the crown having an interior cavity,
wherein the cap is securable onto the neck of the coolant reservoir by being press-fitted thereon,
wherein the interior cavity remains above the neck of the coolant reservoir when the cap is positioned thereon and accommodates the expansion of coolant and buildup of pressure within said coolant reservoir.

10. The coolant reservoir system of claim 9, wherein the crown includes a plurality of spaced apart projections for gripping the cap.

11. The coolant reservoir system of claim 9, wherein the base includes a plurality of spaced apart projections for gripping the cap.

12. The coolant reservoir system of claim 9, wherein the interior cavity of the crown is in fluid communication with the passageway formed in the base.

13. The coolant reservoir system of claim 9, wherein the crown and the base are joined to form an integral, unitary structure.

14. The coolant reservoir system of claim 9, wherein said crown has an inner diameter that is greater than an inner diameter of said base.

15. A coolant reservoir system for a vehicle comprising:
a coolant reservoir having an open neck; and
a cap comprising:
a base having an inner wall defining a central passageway extending vertically therethrough, an indentation formed in the inner wall which defines a ledge for seating the cap onto and in direct contact with said neck of the coolant reservoir; and
a crown disposed atop said base, said crown having an interior cavity formed therein in fluid communication with the central passageway in said base,
wherein said interior cavity remains above the neck of the coolant reservoir when the cap is positioned thereon and accommodates the expansion of coolant and buildup of pressure within said coolant reservoir.

16. The coolant reservoir system of claim 15, wherein said base further includes a top surface, a bottom surface, and an outer wall.

17. The coolant reservoir system of claim 15, wherein said crown and said base are joined to form an integral, unitary structure.

* * * * *